United States Patent [19]

Okada

[11] 3,951,232

[45] Apr. 20, 1976

[54] MULTIFLOOR-TYPE ESCAPE BRIDGE APPARATUS FOR USE IN MULTISTORY BUILDING

[75] Inventor: Satoshi Okada, Kashihara, Japan

[73] Assignee: Toyo Shutter Co., Ltd., Osaka, Japan

[22] Filed: Dec. 4, 1973

[21] Appl. No.: 421,738

[30] Foreign Application Priority Data

| | | |
|---|---|---|
| Dec. 5, 1972 | Japan | 47-121145 |
| May 8, 1973 | Japan | 48-50289 |
| May 8, 1973 | Japan | 48-50290 |
| May 8, 1973 | Japan | 48-53300[U] |
| June 5, 1973 | Japan | 48-62568 |

[52] U.S. Cl. ..... 182/84; 182/142

[51] Int. Cl.[2] ..... E04G 3/00

[58] Field of Search ..... 182/48, 84, 131, 142, 182/143, 144

[56] References Cited

UNITED STATES PATENTS

| | | | |
|---|---|---|---|
| 178,457 | 6/1876 | Nevins | 182/84 |
| 270,955 | 1/1883 | Key | 182/48 |
| 373,658 | 11/1887 | Hart | 182/48 X |
| 931,702 | 8/1909 | Otter | 182/131 X |
| 2,393,087 | 1/1946 | Chiarello | 182/131 X |

*Primary Examiner*—Paul R. Gilliam
*Assistant Examiner*—David H. Corbin
*Attorney, Agent, or Firm*—Stewart and Kolasch, Ltd.

[57] ABSTRACT

This invention provides a multifloor type escape bridge apparatus for use in a multistory building in emergency situation, such as a fire or the like. In a normal situation, the necessary members for example expanders, floor boards, suspension ropes and up and down winding mechanisms are set up between adjacent buildings in a contracted condition under a supporting body. In the case of an emergency, the expanders fixed at the supporting body are extended downwardly so as to set up at each floor a board which provides connections between corresponding openings at opposed walls of said adjacent buildings. This enables individuals to escape from one building to another.

14 Claims, 19 Drawing Figures

MULTIFLOOR-TYPE ESCAPE BRIDGE APPARATUS FOR USE IN MULTISTORY BUILDING

This invention relates to a multifloor type escape bridge apparatus which can be used in multistory buildings for an emergency for example a fire or the like and particularly to a multifloor type escape bridge apparatus comprising opposed openings of a predetermined number disposed at opposed walls of multistory buildings which are adjacent to each other, a supporting body arranged between opposed uppermost openings or both roofs of the buildings, vertically extensible expanders fixed at the longitudinal side edges of said supporting body, a plurality of floor boards fixed at the level of said expander corresponding to each opening of said adjacent buildings to connect them with each other in a state of emergency. A plurality of suspension ropes are fixed at each corner of said supporting body thereby operating synchronously with up and down winding mechanisms provided on said supporting body or on the roof of the buildings.

The present invention, provides a multifloor type escape bridge apparatus for use in multistory building comprising floor boards arranged to be gradually shorter in length and adapted to rest on the surface of stops protruding from opposed walls, said stops set up to be passed by the lower floor board only from the corresponding floor board of each story. Also, according to this invention, it provides a multifloor type rescue bridge apparatus in a multistory building comprising a protruding portion from the length of each stiffening beam united to each floor board at the longitudinal side edges of said floor board and located in different positions as viewed from the top said floor boards resting on stops provided at the corresponding positions of opposing walls. Furthermore, this invention provides a multifloor type rescue bridge apparatus in a multistory building comprising tie-rod mechanisms arranged in the longitudinal direction of the expander and at the longitudinal side edges of each floor board, said mechanisms being bent inside in their inoperative state by contracting said expander. This invention also provides a multifloor type rescue bridge apparatus in a multistory building comprising a plurality of sliding ladders set up between the supporting body and the uppermost floor board and between the floor boards in the flat condition during inoperative times.

BACKGROUND OF THE INVENTION

Recently it has been suggested to establish an escape bridge as a rescue measure for an emergency, such as a fire or the like, between multistory buildings adjacent to each other, for example three-stories buildings.

Heretofore, a single framed floor structure and a boxbridge type structure have been proposed. The former is composed of a bridge plate connected between roofs of buildings adjacent to each other and has the disadvantage that it is not possible to recuse a large number of people from with a roof only and the single framed floor having a relatively short width. The boxbridge type structure is adapted to be connected between buildings adjacent to each other. However which there is the disadvantages of appearance which is not good because said box-bridge type structure is arranged every several stories of a building. Furthermore said box-bridge type structure cannot be arranged between buildings if the space between said buildings is used as a road because of the traffic safety factor like visibility which could be reduced by a lower bridge connected between two-stories of buildiing.

BRIEF SUMMARY OF THE INVENTION

This invention provides a multifloor type bridge apparatus for a multistory building which overcomes the previous disadvantages above and accordingly an object of this invention is to provide an arrangement of elements, for example, expanders, floor boards, suspension ropes and up and down winding mechanisms which are set up between buildings adjacent to each other. The arrangement of said elements are disposed in a contracted state under a supporting body and in the case of an emergency, for example, a fire, the expanders fixed at the supporting body are extended downwardly to set up at each floor a board walk to provide connection between the corresponding openings of the adjacent buildings thereby to allow individuals to be rescued in a short time.

An another object of this invention is to provide a multifloor type bridge apparatus which occupies a small space and has a good appearance wherein in its usual or inoperative state expanders are set up between a supporting body erected at the upper most portion of adjacent buildings and the uppermost floor boards and the floor boards of each story are stored in a compact state. Thus, the undesirable appearance of many crosswalks or bridges extending between adjacent buildings is avoided.

A further object of this invention is to provide a multifloor type bridge apparatus in which, in its usual inoperative state, the expanders and other necessary members are set up between a supporting body erected at the uppermost portions of the buildings and the uppermost floor board and intermediate floor boards of each story stored in contracted condition thereby providing space for passage of persons or vehicles between stories like four-story buildings.

An additional object of this invention is to provide a multifloor type bridge apparatus in which the expanders and other necessary members are made of fireproof material such as steel or the like thereby to prevent the spread of fire.

Still another object of this invention is to provide a multifloor type bridge apparatus in which handrails or safe fences are arranged at the expanders located at the longitudinal sides of each floor board. These handrails prevent individuals from falling from the floor boards.

The supporting body of this invention for a five story building has the strength including its loaded weight, expanders, floor boards, suspension ropes, and the up-down winding mechanisms and of 100 ton. This includes a box-type bridge, a truss-type bridge, a support-type bridge and a type of bridge connected between supporting bodies divided in each building by the use of an expander, said supporting body being made of a fireproof material such as steel or the like. The supporting body is erected directly between opposed walls of adjacent buildings or is erected between roofs of buildings.

The expander has a vertically extensible structure or member and fixedly supports each floor board at each story in predetermined intervals during its extended condition. The expander also includes metal net bodies disposed in parallel relationship or cross-net type, link-chain type, and pantograph type bodies and a tie-rod type mechanism bendable at the inside at both ends or the center of said tie-rod.

Each floor board use in this invention is made of steel material or the like and is fixed to the expander at the longitudinal side edges thereof and the width of each floor board is substantially similar to or more than that of each opposed opening. And, if the height of each opposed opening at the same level, each floor board can be slanted so as to provide an effective connection between the opposed openings and if the positions of opposed openings are not substantially opposite to each other, the form of each floor board can be changed to a trapezoid or the like.

Furthermore, an up and down winding mechanism in this invention is set up on the supporting body or the roof of building and is operated synchronously by the use of suspension ropes, and is a mechanism similar to a rolling door or a winding machine for an elevator and includes a winding drum, a winding motor, a reduction gear mechanism, a governor and a braking mechanism. Said braking mechanism includes a manual push button, a smoke feeler provided in each story of the buildings and an automatic fire feeler like a thermocouple to control the current to said up and down winding mechanism. In the case of an emergency like a fire, the braking mechanism of said up and down winding mechanism is automatically disengaged or the manual push button can be pushed to extend the expander downwardly in slow motion through the governor by operating the suspension ropes. Said braking mechanism includes a single breaking mechanism or a plurality of braking mechanisms set up in each building or set up at the lower part of one or both opposed walls. If the electric current of the buildings is stopped, it is preferable that said braking mechanism is provided with a plurality of plug sockets for connection to outside current. Also, a restrictive mechanism is provided at opposed walls to be operated by its braking mechanism and in the usual inoperative condition, each floor board is restrained through said restrictive mechanism to safely store each floor board in a predetermined place. In an emergency, said restrictive mechanism disengages each floor board from its predetermined restraining place.

BRIEF DESCRIPTION OF THE SEVERAL VIEWS OF THE DRAWING

This invention is described with reference to drawings below wherein:

FIG. 1 shows a view in which an expander is extended downwardly for an emergency situation;

FIG. 2 is a view in which said expander is contracted under a supporting body in its usual or inoperative condition;

FIG. 3 is a cross-sectional view taken along lines III—III of FIG. 1;

FIG. 4 is an enlarged view of an extended expander in a partial section at an emergency;

FIG. 5 is a cross-sectional view taken along lines V—V of FIG. 4 and

FIG. 6 is a plan view with the expander removed;

FIG. 7 is an enlarged view of an essential portion of the bridge in a partial section and FIG. 8 is a partially cross-sectional view taken along lines VIII—VIII of FIG. 7;

FIG. 9 is a partially cross-sectional view of an essential part and

FIG. 10 is a cross-sectional view taken along lines X—X of FIG. 9;

FIG. 11 is a view of an essential part in which the expander is extended downwardly in an emergency, FIG. 12 is a cross-sectional view taken along lines XII—XII of FIG. 11 and FIG. 13 is a similar cross-sectional view to FIG. 12 in its usual inoperative state;

FIG. 14 is a view in which the expander has been extended downwardly;

FIG. 15 is a view in which the expander has been stored in a contracted condition under the supporting body;

FIG. 16 is a cross-sectional view taken along lines XVI—XVI of FIG. 14;

FIG. 17 is an enlarged view of an essential part in a partial section in which the expander has been extended downwardly for an emergency;

FIG. 18 is a cross-sectional view taken along lines XVIII—XVIII of FIG. 17 and FIG. 19 is a plan view with the expander removed.

DETAILED DESCRIPTION

EMBODIMENT 1

Figure 1:
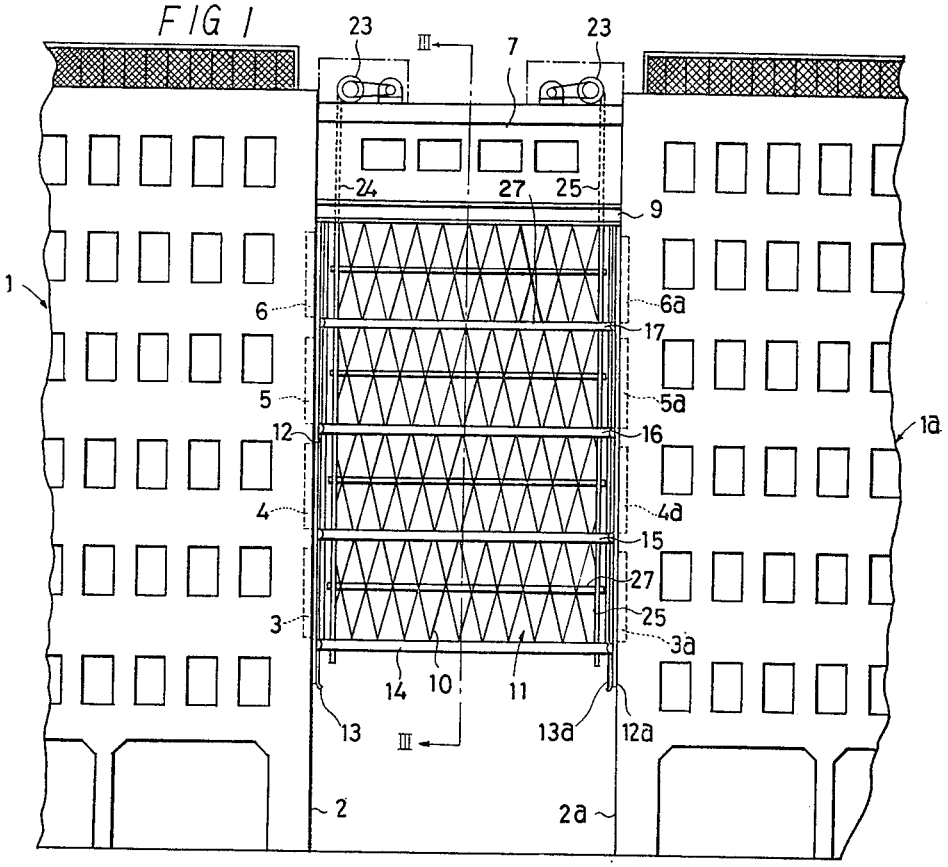
FIGS. 1 to 6 show Embodiment 1 according to this invention.
Figure 2:
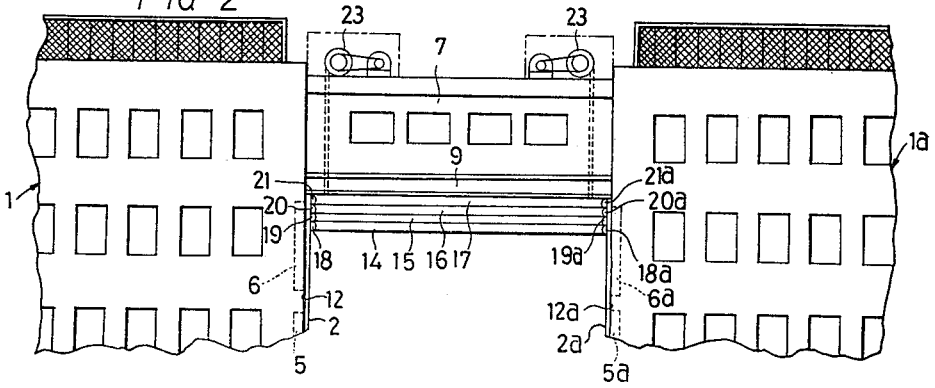

Now, the present invention is described with respect to seven-story buildings located adjacent to each and with particular reference to FIGS. 1 to 6.

To provide for an emergency situation openings (3, 3*a*; 4, 4*a*; 5, 5*a* and 6, 6*a*) are arranged at substantially the same level on opposed walls (2, 2*a*) of the two seven-story buildings (1, 1*a*) from the three-story level to the six-story level. A box-bridge type supporting body (7), which can be made of steel material and the like, is fixedly connected between the two buildings (1, 1*a*) above said openings (6, 6*a*) and a door (8) located in each opening is provided with a necessary lock or key, such as an electromagnetic lock.

Figure 3:
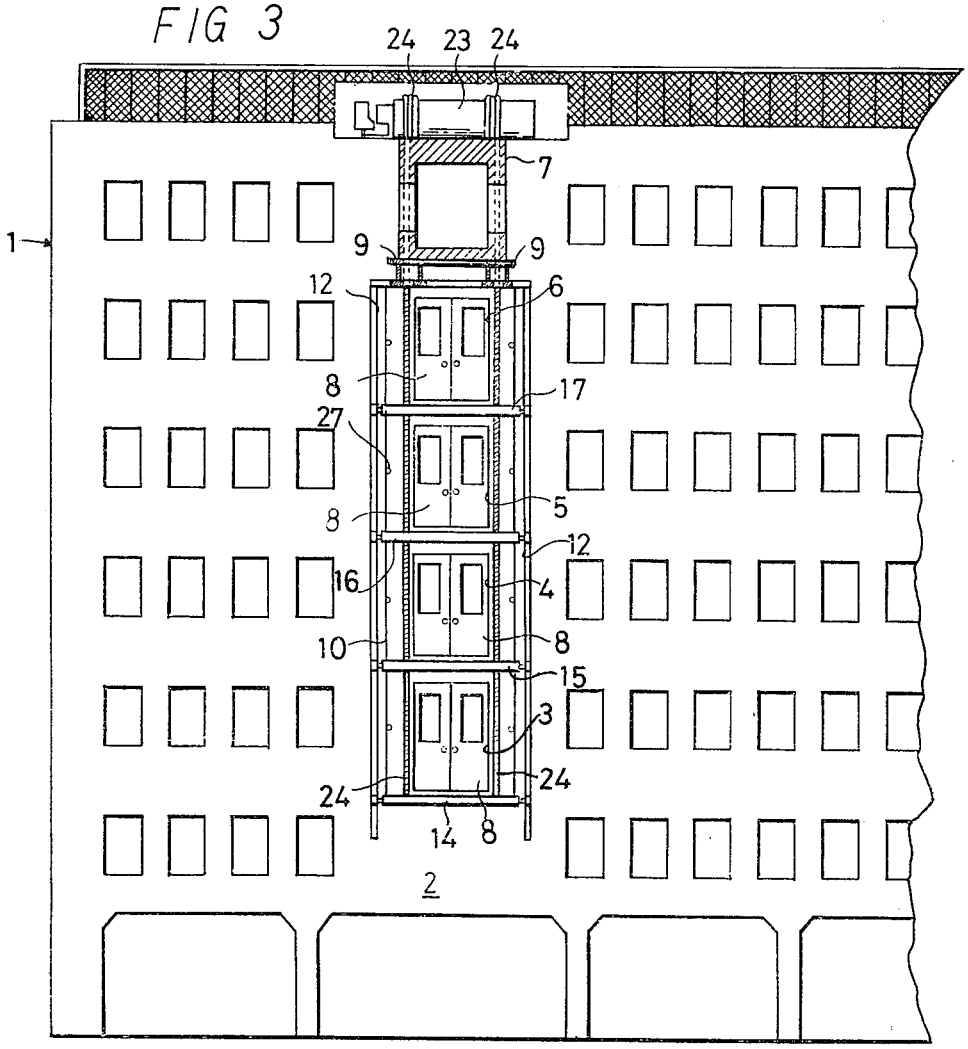

With particular reference to FIG. 3, said supporting body (7) is provided with a stiffening plate (9) having a H-shape cross section, and made of steel material or the like. An expander (11) having a cross-net shape is formed by suspending a plurality of ropes (10) along the longitudinal side edges of said stiffening plate as shown in FIGS. 1 and 4.

Figure 6:
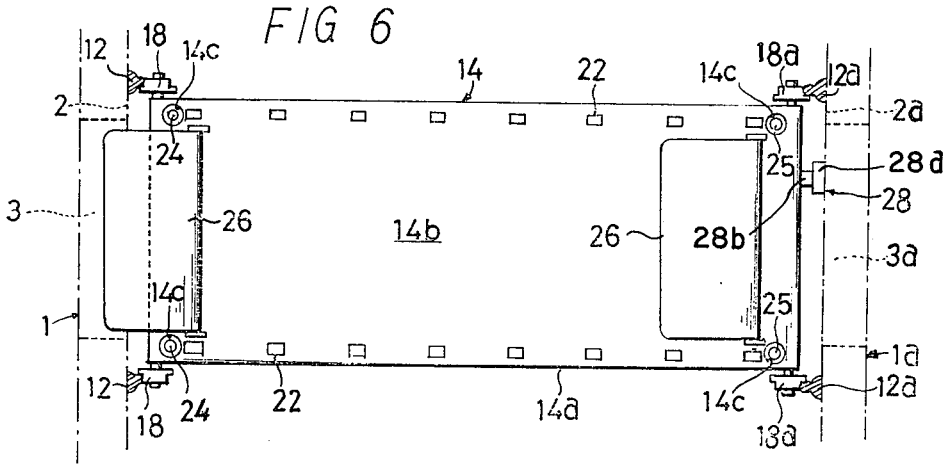

Rails (12, 12*a*) are vertically disposed on opposite sides of said openings (3, 3*a*; 4, 4*a*; 5, 5*a* and 6, 6*a*) and the lower end of each rail (12 or 12*a*) has a curved wheel stop located adjacent to the lower edge of said openings (3, 3*a*) at the two-story level. Wheels (18, 18*a*; 19, 19*a*; 20, 20*a* and 21, 21*a*) rest on each rail through frame member (14*a*) of floor boards (14, 15, 16 and 17). The frame member and floor boards have an inverted U-shaped cross-section in the longitudinal and transverse directions and can be made of steel or the like. Each floor board can be moved vertically and slowly on rails (12, 12*a*) through wheels (18, 18*a*; 19, 19*a*; 20, 20*a* and 21, 21*a*). A floor plate (14*b*) is provided on the surface of each floor board, for example by the use of an adhesive, and a plurality of hooks (22) made of a metallic material or the like is projected upwardly at intervals on both longitudinal side edges of each floor plate (14*b*) or each floor board as shown in FIG. 6. In referring to FIGS. 1 and 4, the rope (10) is engaged with said hooks (22) to form a cross-net shape as indicated by expander (11). It will be clearly understood that the level of each floor board is substantially the same as that of each opening in the buildings (1, 1a) when the expander (11) is used.

Referring to FIGS. 1 and 3, and particularly FIG. 6, holes (14c) for inserting each suspension rope (24, 25) made of steel rope are provided at the four corner of each floor board (14, 15, 16 and 17), said suspension rope being wound around each winding mechanism (23) located on the supporting body (7). Foot boards (26) which are used in the case of an emergency, are pivoted to be rotatable on each floor board. It will be understood that each hook (22) is located in different positions along the longitudinal sides of each floor board to form a cross-net shaped expander (11).

Figure 4:
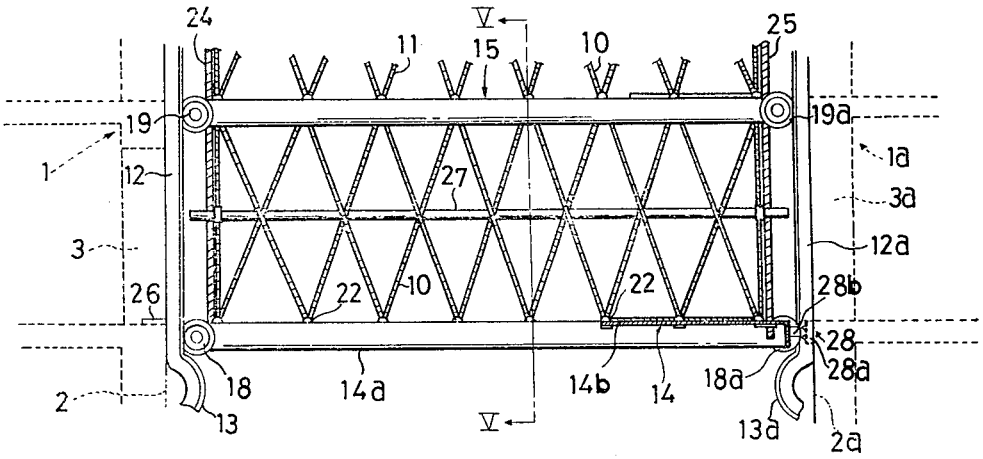
Figure 5:
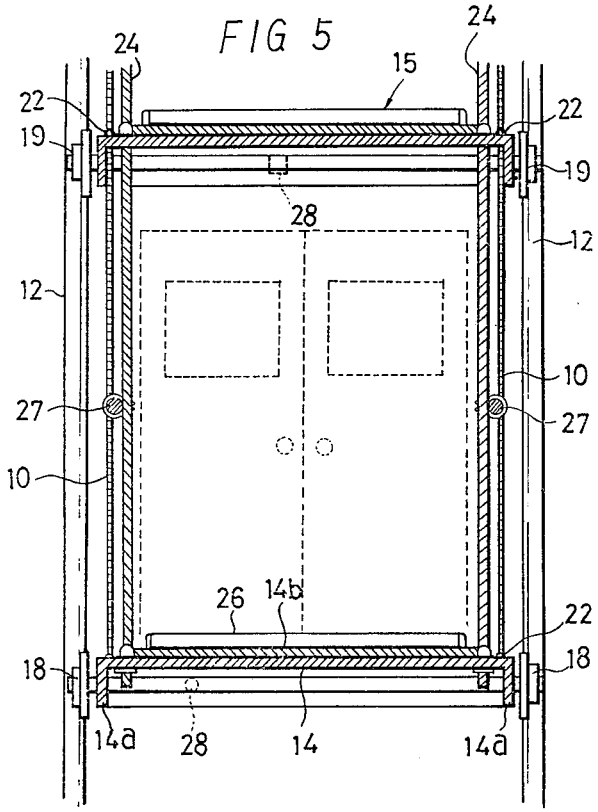

Referring to FIGS. 1 and 3, particularly FIG. 4, handrails (27) are fitted at the middle level of the expander (11) and at both longitudinal sides of each floor board (14, 15, 16 and 17). The hand rails are positioned about 1 m above the bottom of each floor board, said handrails (27) being useful during an emergency.

Each suspension rope (24, 25) is fixed on the back of the lowest floor board (14) from the winding mechanism (23) located on the supporting body (7) through the bottom of said supporting body (7) and through holes (14*c*) provided at the four corners of each floor board (14, 15, 16 and 17).

A means 28 is provided for opening each door. Referring to FIGS. 4 and 6 and said means (28) comprises microswitches (28*a*) provided at the under edge of each opening (3, 3*a*; 4, 4*a*; 5, 5*a* and 6, 6*a*), each microswitch (28*a*) being provided at different positions to act effectively without any hindrance about an up-down movement of each floor board. Protrusions (28*b*) are provided at the transversal direction of each floor board (14, 15, 16 and 17) said protrusions being adapted to engage and disengage with said microswitches which locks an electromagnetic lock provided on the door (8). When said protrusion (28*b*) of each floor board contacts with each microswitch (28*a*) through a lowering movement of each floor board (14, 15, 16 and 17), the door (8) of each opening (3, 3*a*; 4, 4*a*; 5, 5*a* and 6, 6*a*) is opened to cause the individual to escape as shown in FIG. 1. And, conversely when said protrusions (28*b*) disengage from the microswitch (28*a*) through an upward movement of each floor board, the door (8) are closed.

OPERATION

The operation of Embodiment 1 according to this invention is as follows:

The suspension ropes (24, 25) in their normal condition are wound up around the winding mechanism (23) on the supporting body (7) to shorten said suspension ropes with each floor board. In the case of an emergency, the winding mechanism (23) starts by the use of a control or braking mechanism to disengage from the braking mechanism and to extend the suspension ropes (24, 25) in the downward direction. Thus, the lowest floor board (14) of the expander (11) is first lowered slowly between the opposed walls (2, 2*a*). Secondly the floor board (15) is in turn lowered, and the expanders (11) of the remaining floor boards (16, 17) are extended as shown in FIGS. 1 and 4 to set in a predetermined position of each floor board by extending suspension ropes (24, 25). When the suspension ropes (24, 25) have been extended downwardly substantially to their full length, the lowest floor board (14) is set at the predetermined level and the remaining floor boards (15, 16 and 17) are disposed above the level of said floor board (14). Thus, the escapee can be safely and quickly moved in short time from building (1) to another adjacent building (1*a*) through the bridges provided at each floor by floor boards located between opposed openings (3, 3*a*; 4, 4*a*; 5, 5*a* and 6, 6*a*), with the extended expander (11) being formed at both sides of each floor board to prevent the escapee from falling.

After the fire escape operation has been finished, the winding mechanism (23) is activated through the operation of said control mechanism to wind up suspension ropes (24, 25) and the expander (11) is shortened upwardly to overlap each floor board (15, 16 and 17) on the lowest floor board (14). Thus all floor boards (14, 15, 16 and 17) as well as the shortened expander (11) are restrained in suspended condition at the back of supporting body (7) through the braking mechanism and/or restrictive mechanism added thereto.

In addition, there are provided an alarm device and alarm lamp (not shown in the drawings) at the backs of the winding mechanism (23) and the lowest floor board (14) to cause the operator to notice the lowering position and the passers-by passing between both buildings (1, 1*a*) so as not to produce any dangers, another alarm and alarm lamp synchronized with the on-off switching of said electromagenetic lock are provided in rooms to cause the escapee to notice the usable conditions and the positions of the openings.

EMBODIMENT 2

The second embodiment has the following advantages compared with embodiment 1; In order to decrease the occurrence of a rocking motion of the expander (11) in case of an emergency in order to avoid the anxiety of the escapee, to increase safety, and to prevent and damages due to the rocking mootion, specific floor boards or supporting beams fixed at the back of the floor boards are provided, in which the longitudinal length of the top most floor board or supporting beam is slightly longer than that of the subsequent floor board or supporting beam, thereby producing a smooth up-down motion of the expander and to maintain a long duration.

Figure 7:
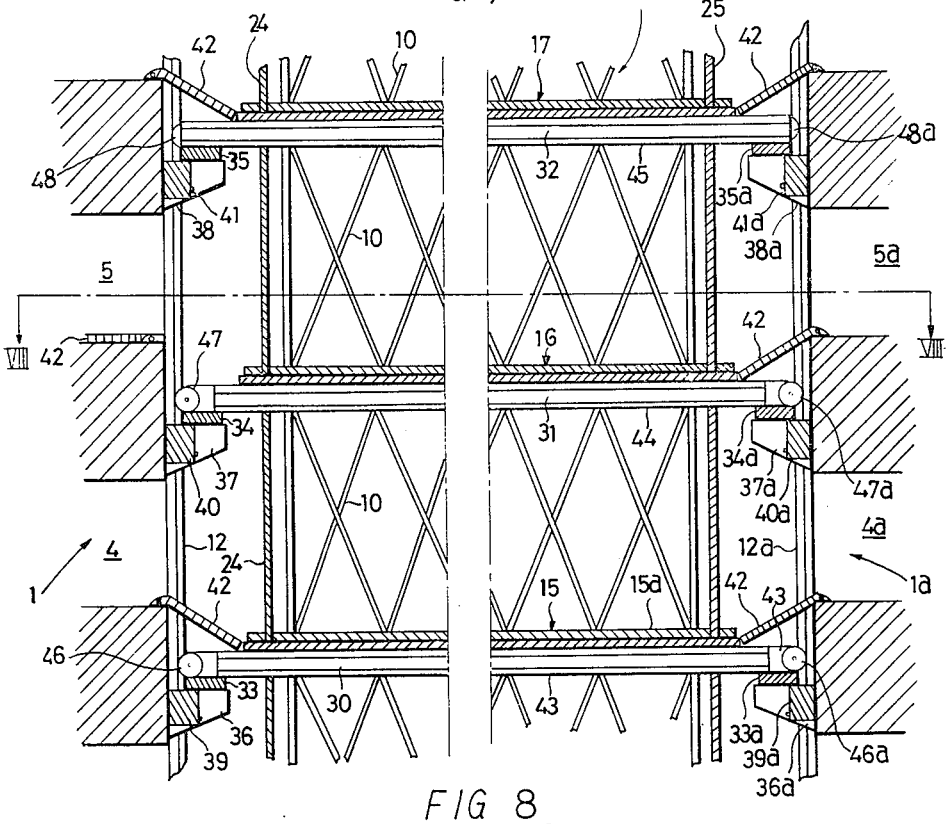
FIGS. 7 and 8 show a second embodiment according to this invention.
Figure 8:
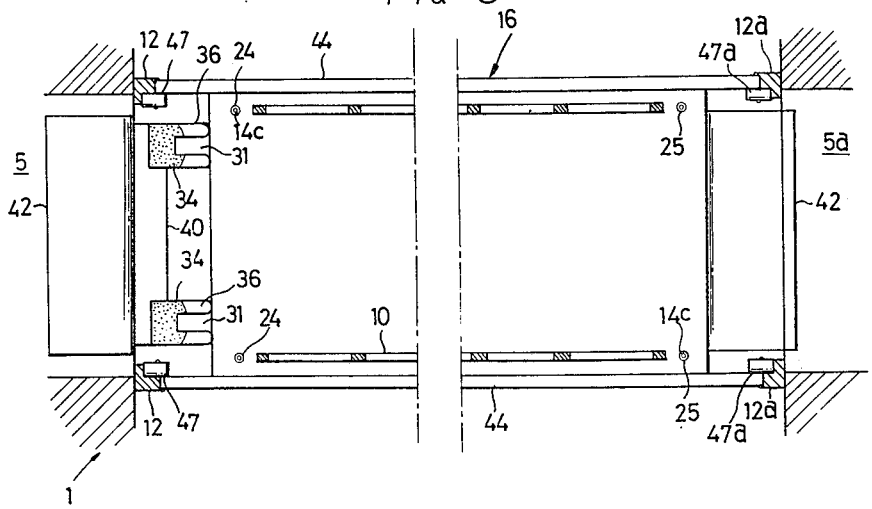

Referring to FIGS. 7 and 8, there are two supporting beams (30, 31 and 32) in each floor board, having a rectangular shaped cross section and made of a steel material or the like. Said supporting beams are fixed at the back of each floor board (15, 16 and 17) and both ends protrude from the entire length of each floor board. Each protruded portion of the supporting beams is maintained on stops (36, 36*a*; 37, 37*a* and 38, 38*a*) through buffer plates (33, 33*a*; 34, 34*a* and 35, 35*a*) which are made of a rubber material or the like. In this case, it will be understood that both ends of the lower supporting beam (30) are shorter than that of the upper supporting beam (31), for example about 10–15 cm shorter and also both ends of said supporting beam (31) are shorter than that of the upper supporting beam (32), for example about 10–15 cm shorter.

A foot board (42) is rotatably provided at the bottom of each opening (4, 4*a*; 5, 5*a*), between each of said openings and each floor board (15, 16 and 17), and stiffening members (43, 44 and 45) made of a steel material or the like are fixed at the longitudinal side edges of each floor board (15, 16 and 17) and wheels (46, 46*a*; 47, 47*a* and 48, 48*a*) supported at both ends of the stiffeniing members can be vertically guided and slid on rails (12, 12*a*). Reference numerals (39, 39*a*; 40, 40*a* and 41, 41*a*) each indicate maintaining portions provided on the walls of buildings (1, 1*a*) for stops (36, 36*a*; 37, 37*a* and 38, 38*a*). These maintaining portions are provided according to necessity by those skilled in the art.

Thus, in accordance with the arrangement of Embodiment 2, three pieces of supporting beams (30, 31 and 32) are fixed at the back of each floor board (15, 16 and 17) and are longer than the both end of said floor boards, for example about 15–30 cm longer. In the case of an emergency, each floor board (15, 16 and 17) is securely supported on the upper portion of stops (36, 36*a*; 37, 37*a* and 38, 38*a*) by extending the expander in the downward direction. This decreases the occurrence of a rocking motion of each floor board, avoids any accidents like a cut expander and enables one to use the safety device without any anxiety. Thus, in the length of each supporting beam (30, 31 and 32), both ends of supporting beam (31) are shorter than that of a lower supporting beam (30), for example about 10–15 cm shorter and both ends of the supporting beam (32) are shorter than that of said supporting beam (31), for example about 10–15 cm shorter. With such a structure, the up-down motion of expander can be carried out smoothly without any problems being created by passing between stops in each story.

EMBODIMENT 3

The object of Embodiment 3 according to this invention is substantially similar to embodiment 2. The occurrence of a rocking motion of the expander (11) is decreased by arranging specific floor boards in alternately different positions as viewed from the top, thereby causing the up-down motion of the expander to increase smoothly.

Figure 9:
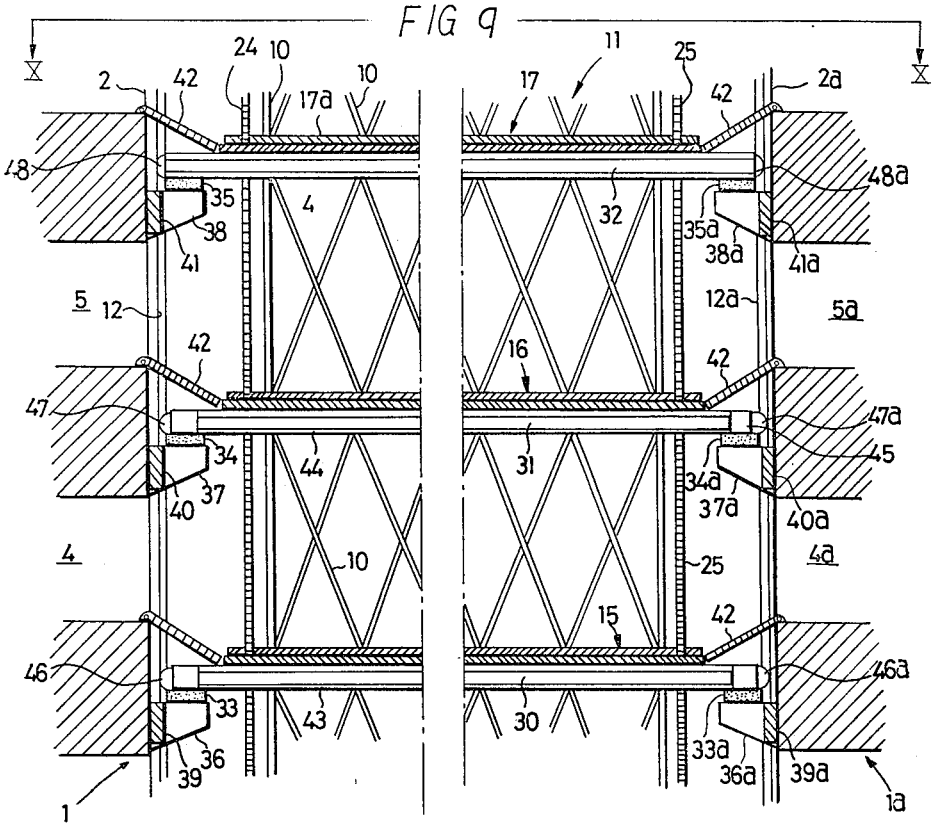
FIGS. 9 and 10 show a third embodiment according to this invention.
Figure 10:
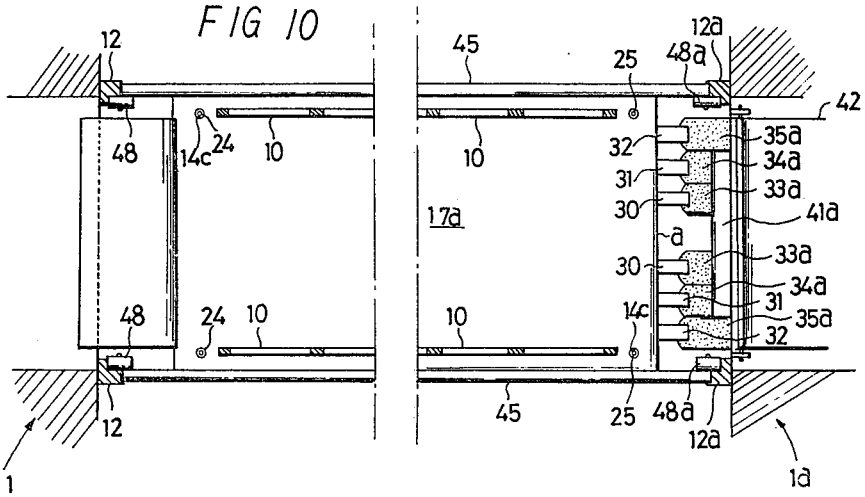

Referring to FIGS. 9 and 10, reference numerals in this embodiment, added to those as indicated in FIGS. 1 to 8, are described as follows:

It will be understood that two pieces of supporting beams (30, 31 and 32) are fixed at the back of each floor board (15, 16 and 17) made of a steel material or the like and both ends of said supporting beams protrude some distance (*a*) [For example about 15–30 cm] from both ends of each floor board and the position of each supporting beam with respect to each floor beam is arranged alternately or staggered as viewed from the top as shown in FIG. 10.

As mentioned above, in this example, the position of each supporting beam (30, 31 and 32) with respect to each floor board (15, 16 and 17) is arranged alternately as viewed from the top, and with such a structure, and in case of an emergency, the expander (11) is extended downwardly to support both protruding ends of floor board (15) or supporting beam (30) at four positions of stops (36, 36*a*) provided with buffer plates (33, 33*a*) of floor board (15) without touching the upper stops (37, 37*a*). Thus the floor boards (16, 17) are safely supported in turn on the surface of stops (37, 37*a*; 37, 38*a*) provided buffer plates (34, 34*a* and 35, 35*a*). According to this embodiment, it can be appreciated that each floor board is safely supported on the surface of stops to avoid the occurrence of a rocking motion created by the running or walking of individuals. Also, this embodiment has further advantage that the up-down motion of expander (11) is carried out smoothly without any problems because no contact of the floor boards or supporting beams is made with respect to floor board or supporting beams in another story.

EMBODIMENT 4

This embodiment shows the use of a tie-rod mechanism having good rigidity, no rocking motion and a high safety factor as an expander of this invention.

Figure 11:
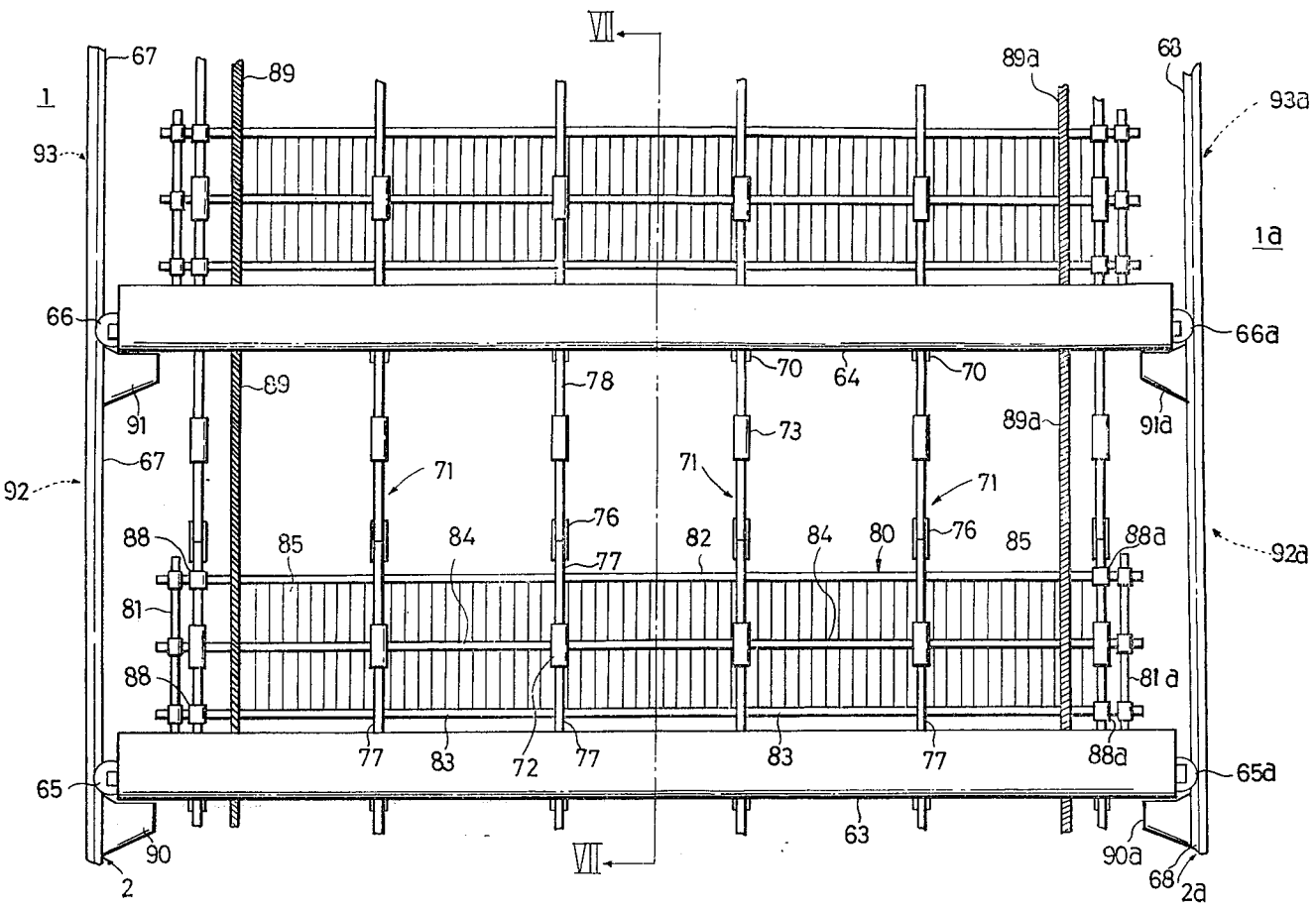
FIGS. 11 to 13 show a fourth embodiment according to this invention.
Figure 12:
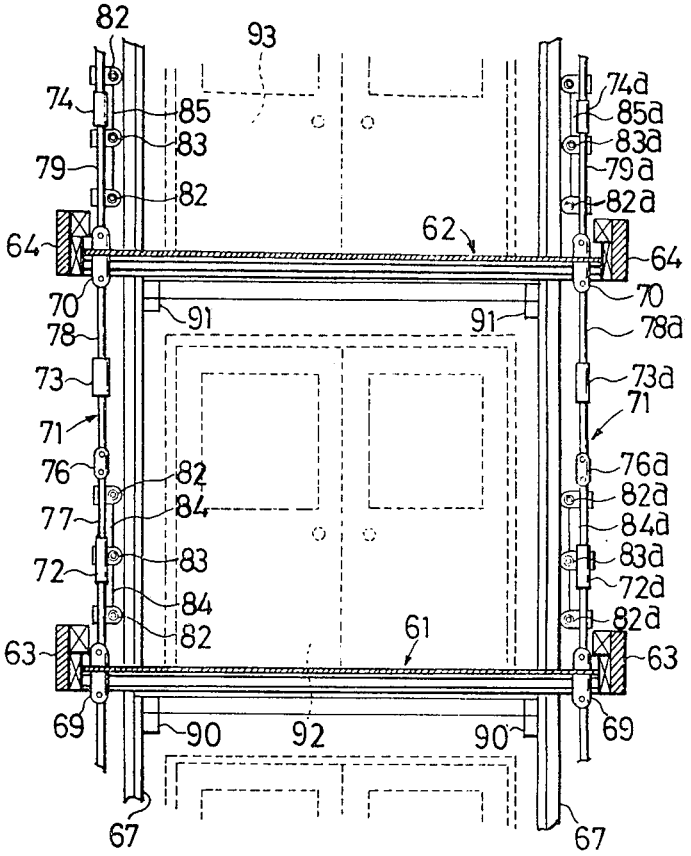
Figure 13:
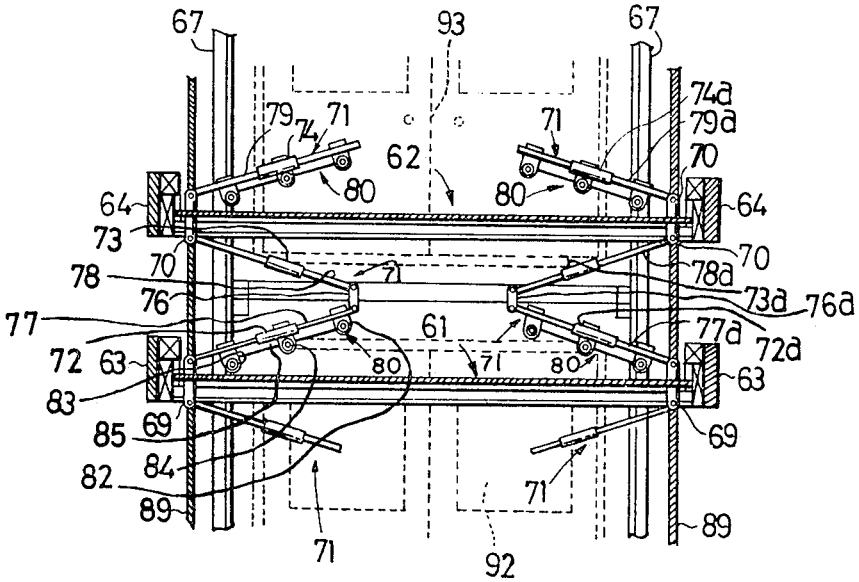

Referring to FIGS. 11 to 13, there are shown floor boards (61, 62) made of steel material or the like and stiffening beams (63, 64) made of steel material or the like fixed vertically at the longitudinal side edges of said floor boards (61, 62). Wheels (65, 65*a*; 66, 66*a*) are supported at both ends of said stiffening beams to slide vertically on the surface of rails (67, 68) provided on walls (2, 2*a*) of building (1, 1a). A plurality of hooks (69, 70) (six hooks are shown in the drawings) are fixed in equal intervals along said floor boards (61, 62) at the longitudinal side edges thereof and at the inner side of said stiffening beams (63, 64) and a plurality of tie-rods (71) are pivoted at the upper and lower ends of said hooks (69, 70) to provide a pivot motion to the inner direction of said hooks. Each tie-rod (71) contains turnbuckles (72, 72*a*; 73, 73*a* and 74, 74*a*), link rods (77, 77*a*; 78, 78*a* 79, 79*a*) and link pieces (76, 76*a*), said link pieces being pivoted at each end of link rods to the inner direction of stiffening beams (63, 64) through said turnbuckles and link rods by the lower motion of the expander, as shown in FIG. 13. There is provided a handrail body (80) located at the inner side of said link bars (77, 77*a*; 78, 78*a* and 79, 79*a*) and at the lower of said link pieces (76, 76*a*) to enable individuals to walk or run easily on the floor boards (61, 62) and to avoid falling from the floor boards. The actual position of said handrail body (80) with respect to each floor board is preferable about 1.2 m above each floor board. The handrail body (80), particularly referring to FIG. 11, is formed of frame bars (81, 81*a*; 82, 82*a* and 83, 83*a*) made of grating at both ends. The upper, lower portions and the middle portion thereof and handrail pieces (84, 84*a*; 85, 85*a*) are also made of grating and are arranged vertically in a predetermined number, for example 6 pieces between frame bars (81, 81*a*) of both ends and between frame bars (82, 82*a*). Reference numerals (89, 89*a*) show operating ropes for vertically winding said floor boards up and down, and said operating ropes (89, 89*a*) are fixed at the back of the lowest floor board through holes provided at four corners of each floor board (not shown). Reference numerals (88, 88*a*) indicate holding pieces, reference numerals (90, 90*a*; 91, 91*a*) also indicate holders for supporting each floor board in an emergency and reference numerals (92, 92*a* and 93, 93*a*) show openings provided in the buildings for emergency.

According to the structure of Embodiment 4, in the case of an emergency, the bottom of each floor board (61, 62) having good rigidity is securely maintained on the surface of holder (90, 90*a* and 91, 91*a*) to decrease the occurrence of a rocking motion of the floor boards by the walking or running by an individual on the surface of each floor board and to avoid any accidents like cutting the floor board. In addition, the individual can be moved away safely and quickly from one building (1) to another building (1*a*) by a use of a rigid handrail body (80). After the rescue operation has been finished, each floor board is wound up vertically by the use of operating ropes (89, 89*a*) which bend inside link bars (77, 77*a;* 78, 78*a* and 79, 79*a*) of tie-rod (71) and thus, they are stored conveniently between the floor boards in a small space.

In Embodiment 4, it will be appreciated that a spring means (not shown) can be fitted with any one of the link bars (77, 77*a;* 78, 78*a* and 79, 79*a*) to restrict on the inside the bending direction of tie-rod (71), or any detents (not shown) can be provided between link pieces (76, 76*a*) for securely connecting them.

EMBODIMENT 5

This embodiment is an improvement in embodiments 1 to 4 described here-in-above and has the feature in which a plurality of sliding ladders is vertically or obliquely provided between floor boards of upper aand lower stories, for example, adjacent stories and in the case of an emergency, the individual can be rescued safely and quickly to the upper story or lower story through said sliding ladders. Also, this embodiment has the further feature wherein an inside bendable tie-rod mechanism is provided with each floor board in each story of the building as an expander to decrease the rocking motion of each floor board while in use.

Figure 14:
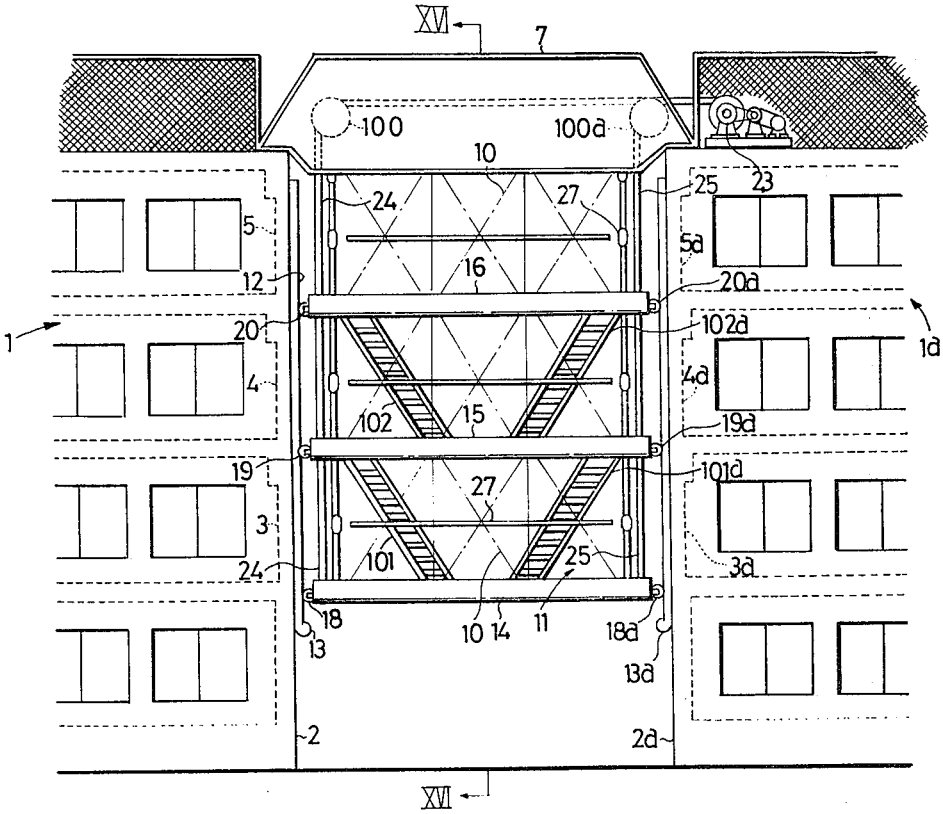
FIGS. 14 to 19 show Example 5 according to this invention.
Figure 15:
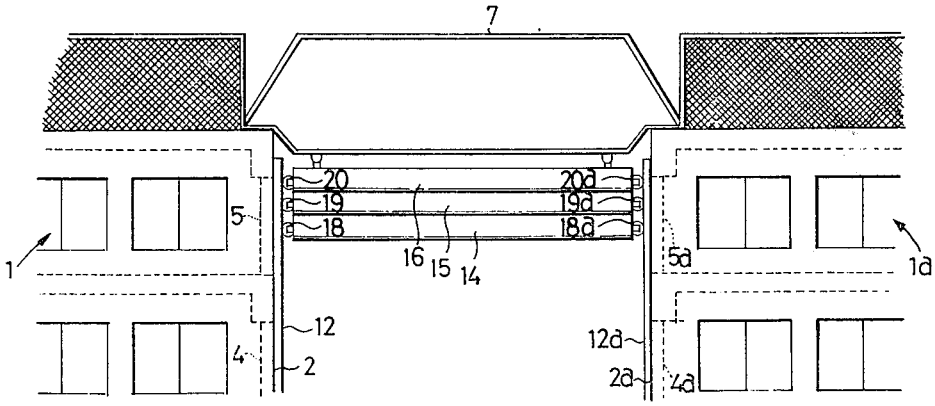
Figure 16:
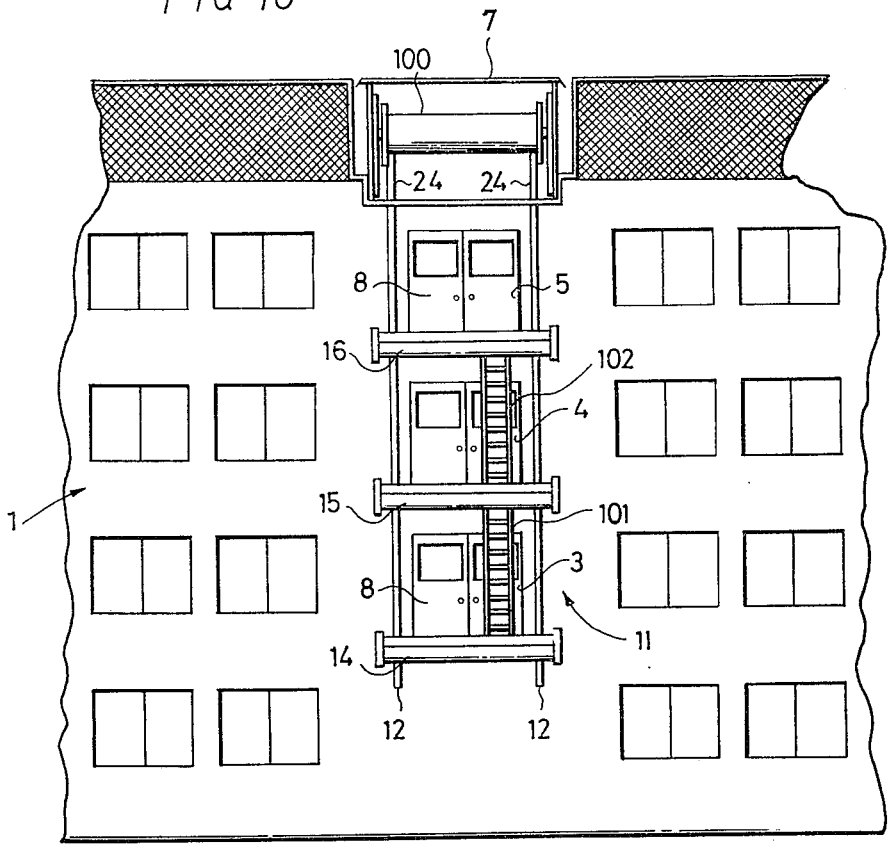
Figure 19:
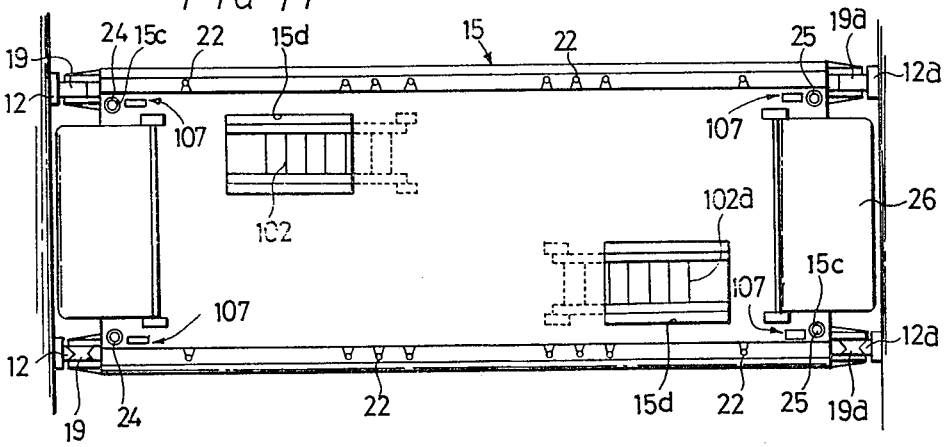
Figure 18:
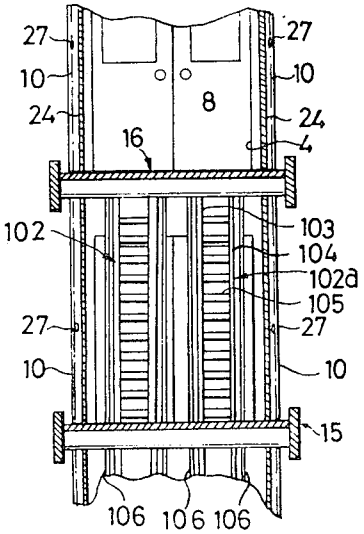
Figure 17:
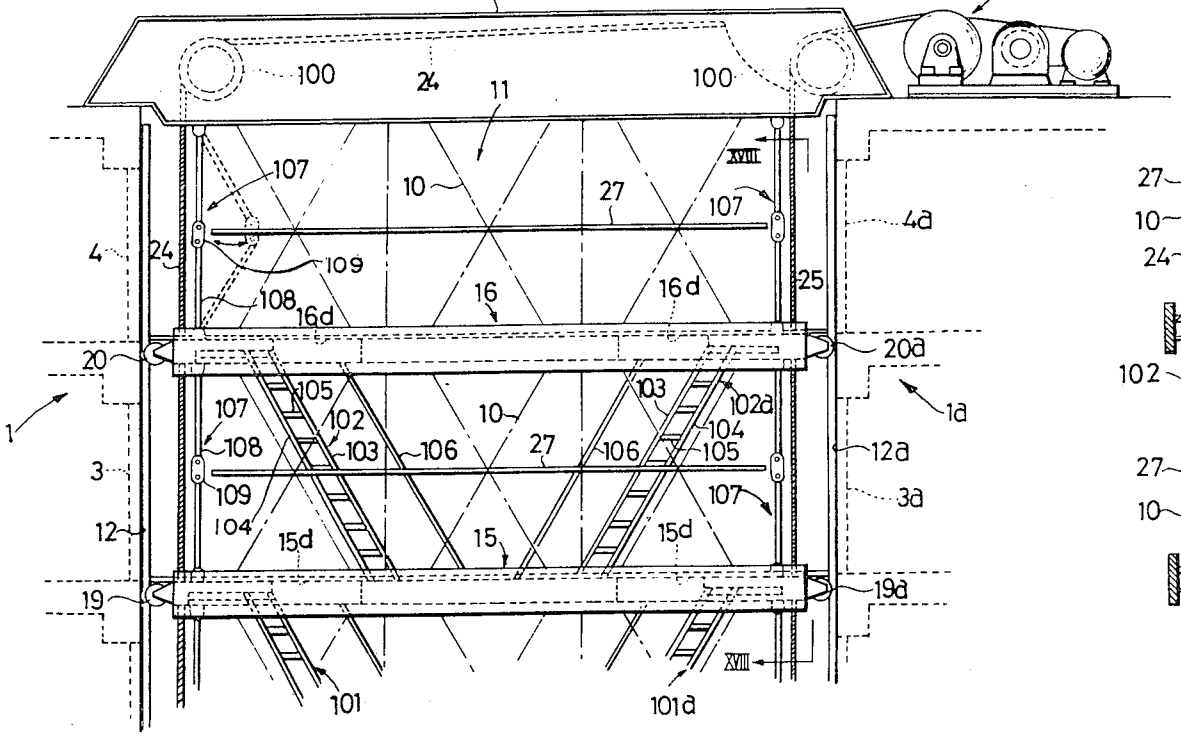

Referring to FIGS. 14 to 19, particularly to FIG. 14 and 19, each opening (15*d*, 16*d*) for each sliding ladder is provided in the plane of each floor board (15, 16) and is located in different position as viewed from the top and rigid sliding ladder (101, 101*a;* 102, 102*a*) of parallel link mechanism are obliquely placed between the lower floor board (14) and upper floor board (15) and said floor board (15) and the upper floor board (16). Said sliding ladders (102, 102*a*), particularly referring to FIG. 17, include a pair of side rails (103, 104) and a plurality of stayes (105) between said side rails which are kept horizontal at the moment of use, that is, in the case of an emergency. When each floor board (15, 16) is drawn together by the use of operating ropes (24, 25), the top end of said sliding ladder (102) horizontally slides on the surface of the upper floor board (16) through the opening (16*d*) and is set up between the floor boards (15) and (16). And, conversely, after the rescue operation has been finished, the upper and lower floor boards (15, 16) are separated from each other and then, said sliding ladders (102, 102*a*) are returned to the usual state by raising said ladders. Reference numeral (106) indicates a handrail which is used for the sliding ladders and reference numeral (107) indicates a tie-rod mechanism, said tie-rod mechanism being provided between the supporting body (7) having winding drums (100, 100*a*) and the uppermost floor board (16) and between said floor board (16) and the floor board (15), and said floor board (15) and floor board (14) at the four corners thereof and is composed of a link bar (108) and a link piece (109). In the usual condition, the tie-rod mechanism (107) is placed to be bent inside said link piece (109) by approaching each floor board as shown in FIG. 15 and conversely, in the case of a state of emergency, said tie-rod mechanism (107) is vertically extended as shown in FIGS. 14 and 17, thereby causing the refugee to walk or run safely and quickly on the surface of each floor board by decreasing the rocking motion of each floor board. In the drawings, reference numeral (15*c*) indicates a hole for inserting suspension ropes (24, 25) provided at four corners of each floor board.

According to Embodiment 5, sliding ladders (101, 101*a* and 102, 102*a*) are set up between the supporting body (7) and the uppermost floor board (16) and between the floor boards (16) and (15), and (15) and (14), so that it will be appreciated that the individual can be safely and quickly moved to the upper story or lower story in an emergency.

The sliding ladder has used the parallel link mechanism in this example but it will be understood that a ladder having a plurality of staves and flexible ropes can be used like the sliding ladder.

The features of this invention have been described in five embodiments but it will be also clear that this invention can be adapted a constructing or painting operation or the like and various variations and changes can be carried out without departing from the sprit and scope of the invention, especially as defined in the following claims.

What is claimed:

1. A multifloor-type escape bridge for use in adjacent multistory buldings which comprises opposed openings provided at the opposed walls of said adjacent buildings at various levels of said buildings, a supporting body fixedly connected between said buildings at a level at or above the upper opposed openings, a plurality of floor boards or platforms adapted to be suspended from said supporting body so that in its extended state, each of said platforms connect opposed openings of said adjacent buildings, guide rails attached to each building on opposite sides of said openings for guiding said plurality of suspended platforms, an up and down winding mechanism associated with said supporting body or the roof of said buildings, and a plurality of suspension ropes fixed to the bottom of the lower most platform and extending through the intermediate platforms and the supporting body and in operative association with said winding mechanism for lowering and raising said plurality of platforms.

2. The multifloor-type escape bridge of claim 1, wherein said plurality of suspension ropes are disposed at each corner of the supporting body and each corner of said platforms.

3. The multifloor-type escape bridge of claim 1, wherein vertically extending expanders are fixed at the longitudinal side edges of the supporting body and adjacent platforms.

4. The multifloor-type escape bridge of claim 1, wherein said supporting body is a box-type bridge, a truss-type bridge, a support-type bridge and support bodies connected with expanders.

5. The multifloor-type escape bridge of claim 3, wherein said expanders, in their extended state, fixedly support each platform at each level, said expanders including a metal net body having a parallel or cross-net design, a link-chain type, a pantograph type or a tie-rod type mechanism bendable inside at both ends or at the center of said tie-rod.

6. The multifloor-type escape bridge of claim 3, wherein said platforms are made of a metallic material and the expanders are fixed to the longitudinal side edges thereof and the width of each platform is substantially equal to or greater than each of said opposed openings.

7. The multifloor-type escape bridge of claim 1, wherein the winding mechanism includes a winding drum, a winding motor, a reduction gear mechanism, a governor and a braking mechanism in operative association with each other.

8. The multifloor-type escape bridge of claim 3, wherein a handrail body is fixed to the expander at the longitudinal sides of each platform.

9. The multifloor-type escape bridge of claim 1, wherein the platforms are provided with wheels which are in operative engagement with said side rails.

10. A multifloor type escape bridge according to claim 1 wherein at each level of the escape bridge the floor board is supported by supporting beams, said supporting beams being respectively shorter from the top to the bottom of the escape bridge, stops extending from the opposed walls of said adjacent buildings at the various levels of said buildings, each of said supporting beams being adapted to engage a pair of stops when the escape bridge is extended between said adjacent buildings.

11. A multifloor type escape bridge according to claim 1 wherein at each level of the escape bridge the floor board is supported by supporting beams, stops extending from the opposed walls of said adjacent buildings at the various levels of said buildings, the stops at each level being staggered with respect to the stops of the next adjacent level, each of said supporting beams being adapted to engage a pair of stops when the escape bridge is extended between said adjacent buildings.

12. A multifloor type escape bridge according to claim 3 wherein a tie-rod mechanism is arranged at the longitudinal direction of the expander and at the longitudinal side edges of each floor board, said tie-rod mechanism being bent inside in its inoperative state by contracting said expander.

13. A multifloor type escape bridge according to claim 1 wherein a plurality of sliding ladders are disposed between the supporting body and the uppermost floor board and between adjacent floor boards said ladder being collapsible to a flat state between said floor boards when the escape bridge is in a collapsed state.

14. A multifloor type escape bridge according to claim 13 wherein said sliding ladder includes a movable ladder of rigid parallel link mechanism or a ladder comprising a plurality of staves connected to each other by flexible ropes.

* * * * *